US005746006A

United States Patent [19]

Duske et al.

[11] Patent Number: 5,746,006

[45] Date of Patent: May 5, 1998

[54] SINGLE PASS ROTARY DRYER

[75] Inventors: Wilfried P. Duske, Franklin; Robert T. Hogue, Burlington; Kenneth J. Koeslin, Greenfield, all of Wis.

[73] Assignee: Duske Engineering Co., Inc., Franklin, Wis.

[21] Appl. No.: 741,138

[22] Filed: Oct. 29, 1996

[51] Int. Cl.[6] ..... F26B 11/02

[52] U.S. Cl. ..... 34/136

[58] Field of Search ..... 34/132, 135, 136, 34/138, 139, 141, 142, 179, 181, 182, 183; 210/151; 366/25, 57, 226; 432/118

[56] References Cited

U.S. PATENT DOCUMENTS

| | | | |
|---|---|---|---|
| 2,007,298 | 7/1935 | Fasting | 222/7 |
| 2,924,513 | 2/1960 | Altimier et al. | 34/135 |
| 3,360,868 | 1/1968 | Arnold | 34/13 |
| 3,619,908 | 11/1971 | Kallas | 34/132 X |
| 3,713,633 | 1/1973 | Falk et al. | 34/135 X |
| 4,035,925 | 7/1977 | Brown et al. | 34/135 X |
| 4,193,208 | 3/1980 | Ronning | 34/136 X |
| 4,742,622 | 5/1988 | Thompson | 34/12 |
| 5,455,005 | 10/1995 | Clawson et al. | 34/135 X |
| 5,525,239 | 6/1996 | Duske | 210/739 |
| 5,555,639 | 9/1996 | Livingston et al. | 34/135 |

OTHER PUBLICATIONS

Excerpts from a product brochure "Flo–Dry Rotary Dryer, The Versatile Choice . . . " by Flo–Dry Technology Limited, published 1985.

Excerpts from a product brochure "M–E–C Dryer Systems" by M–E–C Company, publised Apr. 1990.

Excerpts from a product brochure "Dryers, Kilns, Coolers" by Standard Steel Corporation, published in 1960 or earlier.

*Primary Examiner*—Henry A. Bennett
*Assistant Examiner*—Steve Gravini
*Attorney, Agent, or Firm*—Miller, Simon, McGinn & Clark S.C.

[57] ABSTRACT

A single pass rotary dryer in which heated gas and a moist material is blown through a rotating drum. The drum has inwardly extending flights or vanes which deflect particles of the material back into the gas flow. A flight is oriented at an oblique angle to the longitudinal axis of the drum in order to present an ascending ramp to incoming material. There is a core oriented longitudinally in the drum. The core may be hollow and perforated with holes through which particles of material may pass. The core may have flights and a narrowing closed end facing the incoming material.

19 Claims, 6 Drawing Sheets

FIG. 3
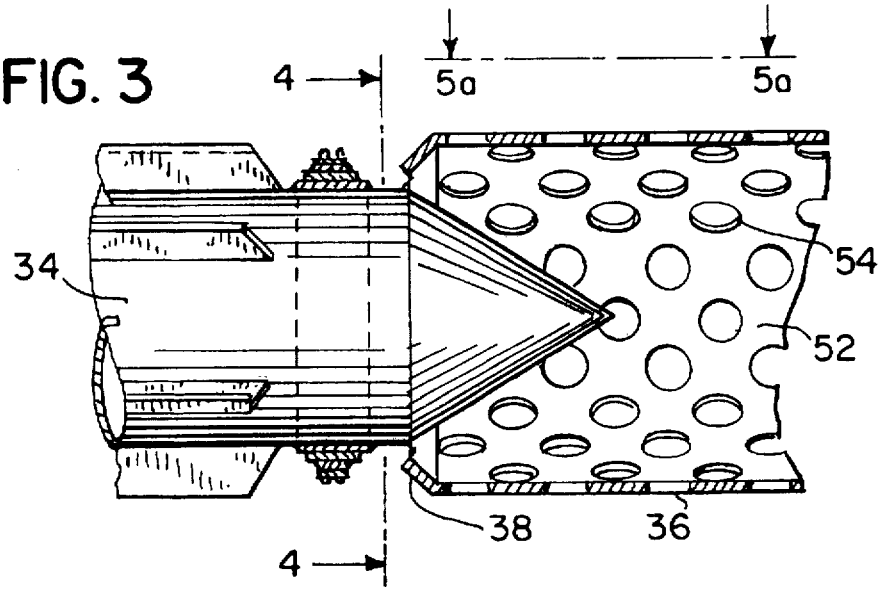
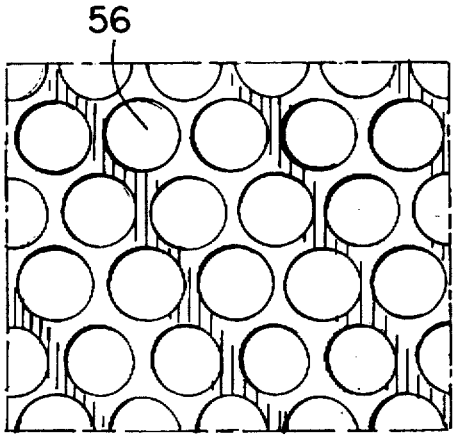
FIG. 5(a)
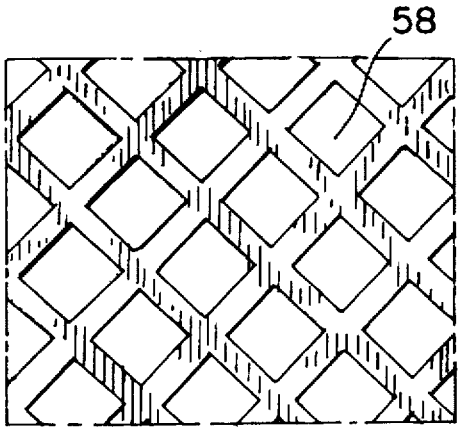
FIG. 5(b)
FIG. 4
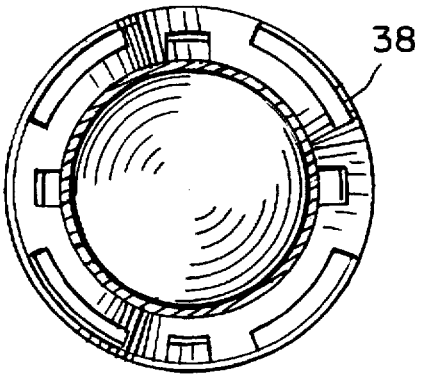

FIG. 7
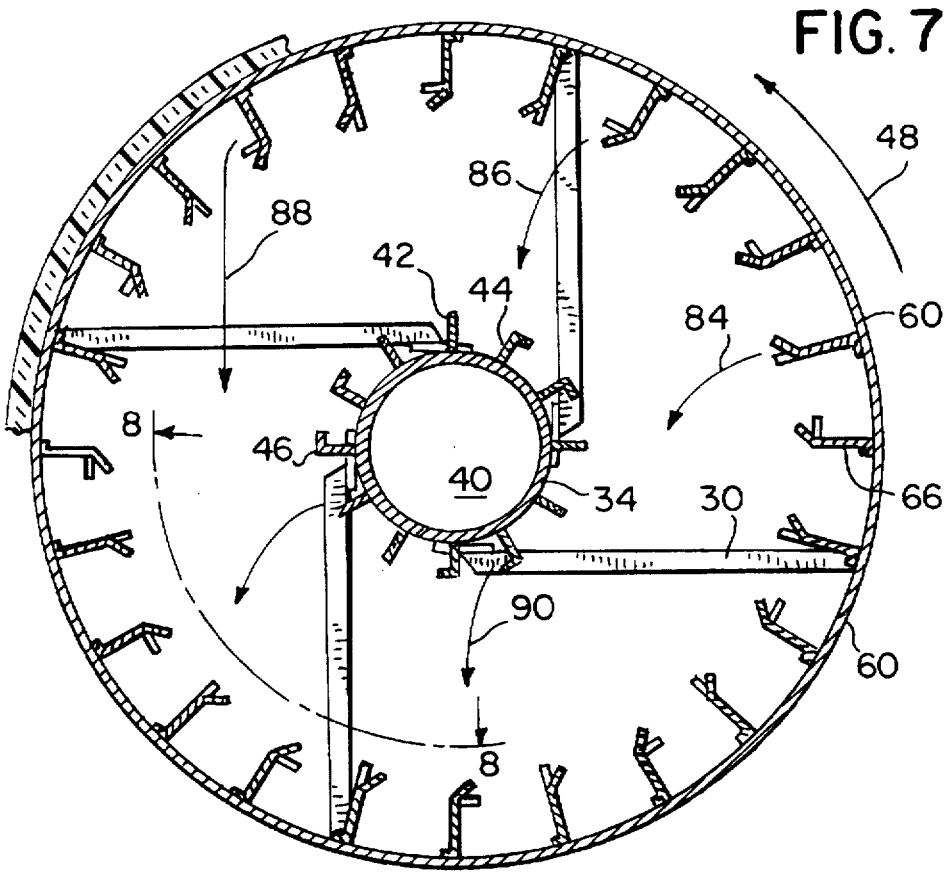
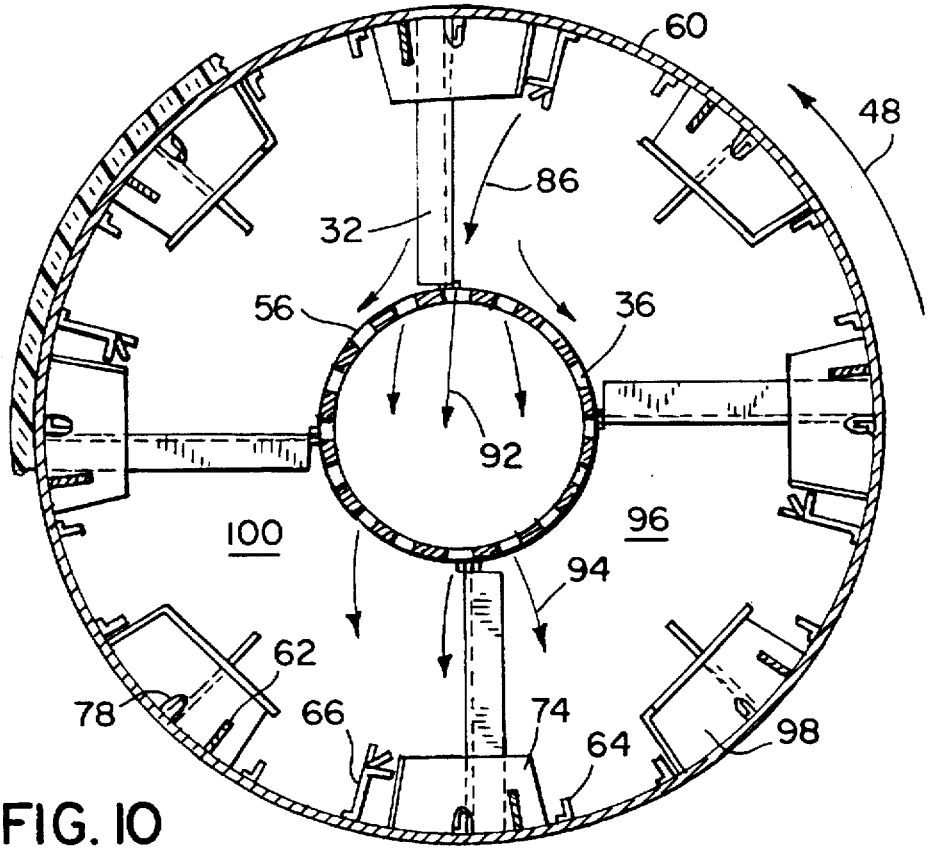
FIG. 10

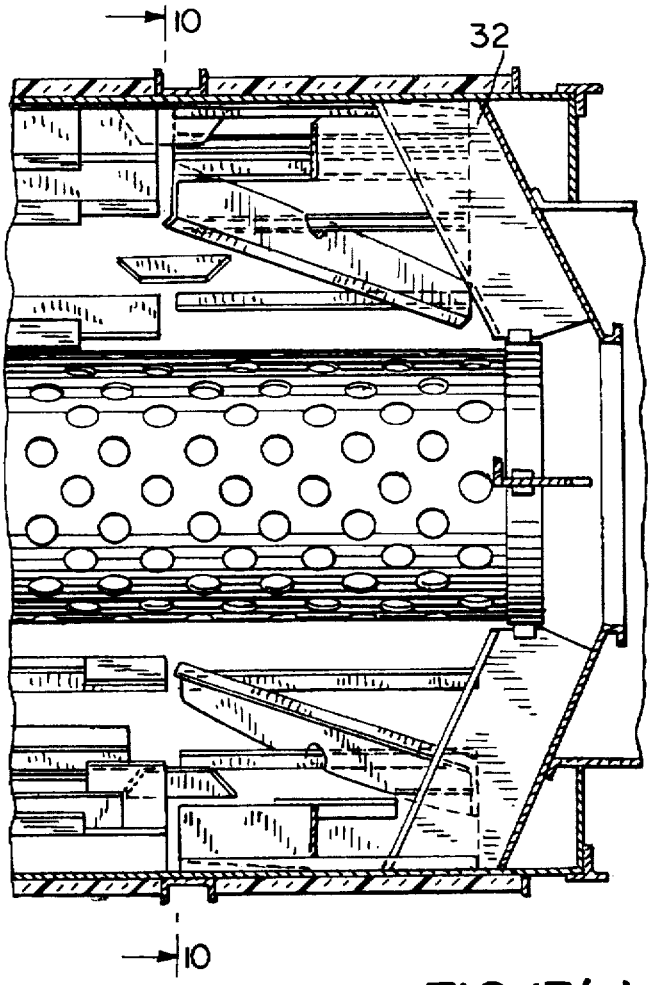
FIG. 9
FIG. 13(a)
FIG. 13(b)
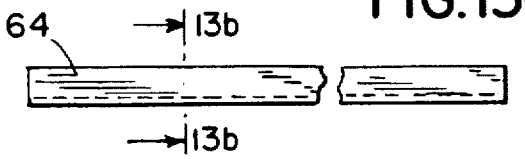
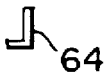
FIG. 14(a)
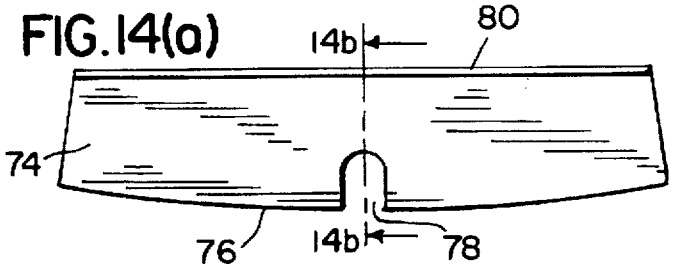
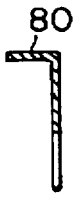
FIG. 14(b)
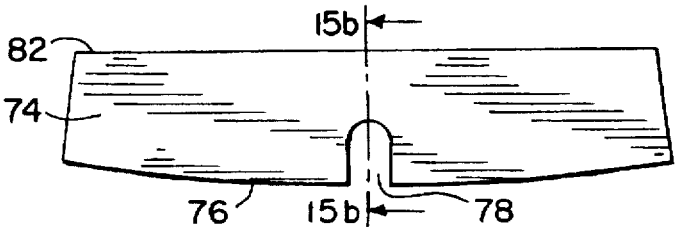
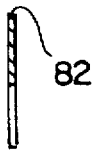
FIG. 15(b)
FIG. 15(a)

SINGLE PASS ROTARY DRYER

BACKGROUND OF THE INVENTION

The invention relates to rotary dryers for removing moisture from wet organic, chemical and other matter (hereinafter "material") to yield a drier product which is more manageable and valuable.

In rotary drying, material and a flow of heated gases (such as air) are continuously introduced into a rotating drum. As the material moves through the drum toward an exit port, it is dried by the heated gas. Flights extending inwardly from the drum wall cause the material to shower through the flow of heated gas to facilitate drying and reduce clotting. (As used herein, the term "flight" refers to a relatively thin and rigid blade or vane which may be flat or curved and may or may not have one or more bent portions.) The material's final moisture content depends on the temperature and velocity of the gases and the rotation speed, all of which can be controlled.

Increasing the velocity of the gases facilitates drying speed but also tends to offset this effect by reducing the time spent in the dryer by the material particles ("dwell time"). To avoid extending the length of the dryer in order to allow the material to dry sufficiently, multiple-pass (typically triple-pass) rotary dryers were developed. A triple-pass dryer consists of three concentric cylinders rotating at the same speed. The material moves through one cylinder, is forced in the reverse direction through another cylinder and passes in the original direction through the third cylinder to the exit port. Triple-pass dryers are relatively expensive to build and operate. Their internal structures are complicated and hard to access for inspection and maintenance. Their complexity limits their useful lives.

To avoid the added costs and complexity of multiple-pass dryers, there is a need to improve single-pass dryers to enable them to achieve comparable or superior drying characteristics without adding significantly to their lengths.

BRIEF SUMMARY OF THE INVENTION

The present invention is directed to an apparatus that satisfies this need.

The invention provides an apparatus for drying moist material. In the apparatus, a blower, which is in communication with a supply of a gas, establishes a moving gas stream, which is heated. There is a feeder which discharges the material into the gas stream so that the gas stream carries the material. The apparatus includes a drum which rotates in an operating direction about a longitudinal axis. The drum has an inlet for the stream of gas and material and an outlet for discharging the stream of gas and material. At least one flight extends inwardly from the wall of the drum. The flight is aligned at an oblique angle with respect to the longitudinal axis.

In another aspect, the apparatus has a tubular core mounted longitudinally within the drum. The tube has a portion which is hollow and has a perforated wall. The perforations may be circular, rectangular or of another shape. The core may have another portion which has a closed, narrowing end which faces the incoming material. That portion may also have flights which deflect and deposit particles of the material.

The present invention has the advantages of allowing higher velocities of the heated gases and increasing the material's exposure to the heated gases by improving the showering effect and increasing dwell time. This results in faster, more efficient and more effective drying without extending the length of a single-pass rotary dryer.

BRIEF DESCRIPTION OF THE SEVERAL VIEWS OF THE DRAWING

These and other features, aspects and advantages of the present invention will become better understood with reference to the following description and claims and to the accompanying drawings, where:

FIG. 3 is a partially cross-sectional view of the junction of flighted and perforated portions of the core;

FIG. 4 is a cross-sectional view along line 4—4 of FIG. 3;

FIG. 5(*a*) illustrates circular perforations of one version of the core;

FIG. 5(*b*) illustrates rectangular perforations of another version of the core;

FIG. 7 is a cross-sectional view along line 7—7 of FIG. 6;

FIG. 9 illustrates a rear portion of a core and triple-bend flights, helical flights and straight flights extending inwardly from a drum wall;

FIG. 10 is a cross-sectional view along line 10—10 of FIG. 9;

FIGS. 13(*a*) and (*b*) illustrate a straight flight;

FIGS. 14(*a*) and (*b*) illustrate a helical flight; and

FIGS. 15(*a*) and (*b*) illustrate a straight flight.

DETAILED DESCRIPTION OF A PREFERRED EMBODIMENT OF THE INVENTION

Figure 1:
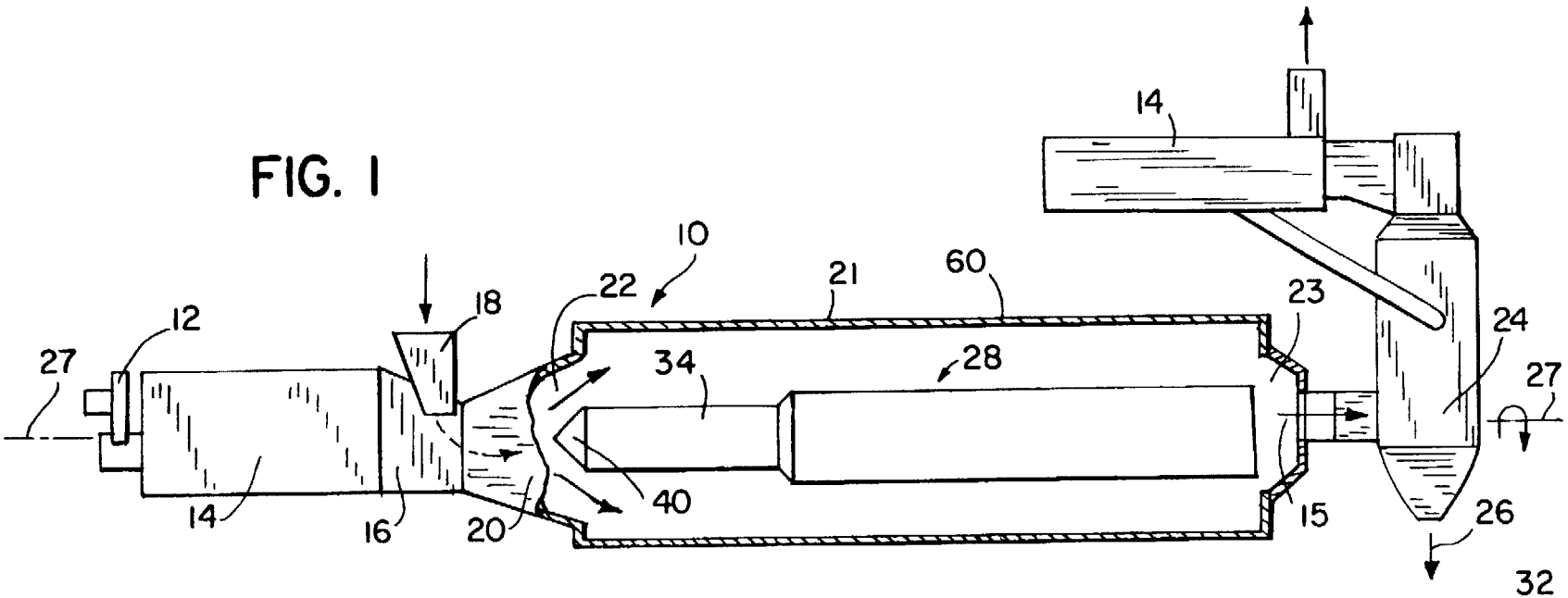
FIG. 1 is a schematic, partially cross-sectional, representation of an embodiment of the present invention.

As shown in FIG. 1, a preferred embodiment of a single-pass, direct-contact, concurrent-flow rotary dryer in accordance with the present invention is designated generally by the reference character 10. As shown, it includes a heater 12, which heats a gas (such as air) supplied to a chamber 13 which is subject to a suction produced by a blower 14, which is capable of producing a forceful stream of heated gas moving in direction 15. The stream of high temperature gas passes through a conduit 16, which has a feeder 18, which deposits material into the gas stream.

The stream of heated gas begins separating the material into particles and carries them through a conical portal 20 to a drum 21 which is rotated by an electric motor and chain drive or other means (not shown). The conical portal 20 spreads the gas and particle flow and also causes a re-circulatory effect in region 22, which moderates the temperature of the conical portal 20 and other surfaces in region 22.

The stream of heated gas carries the material through the rotating drum 21, out of an outlet 23 and into a collector, which may be a cyclone type separator 24 which, by means of an gas lock (not shown), discharges (as indicated at 26) the dried material into a collection apparatus (not shown) and releases the exhaust gases into an gas quality control device.

Figure 6:
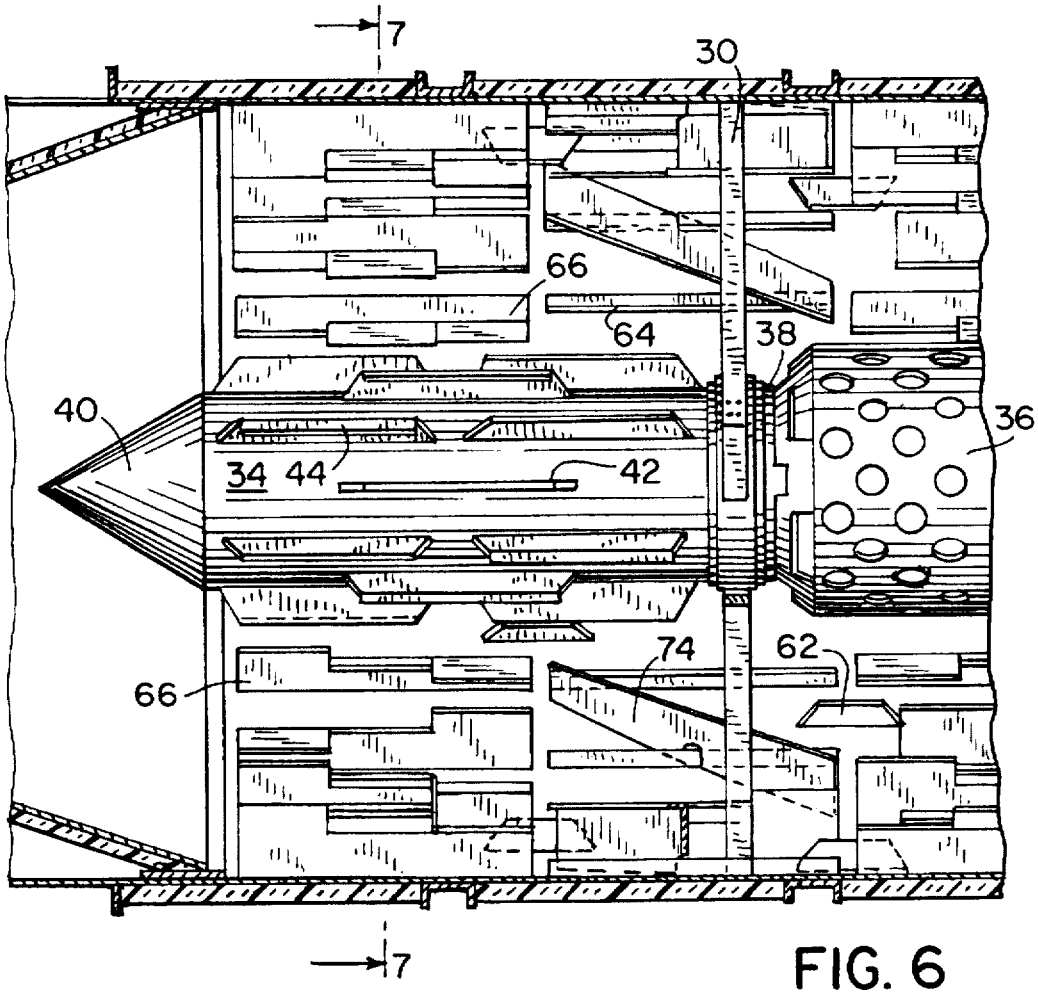
FIG. 6 illustrates a forward portion of a core and triple-bent flights, helical flights and straight flights extending inwardly from a drum wall.
Figure 11:
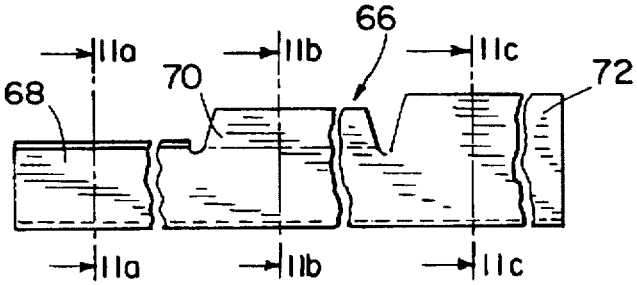
FIG. 11 illustrates a triple-bend flight, with FIGS. 11(*a*), (*b*) and (*c*) being cross-sectional views of the three bends of the flight.
Figure 11A:
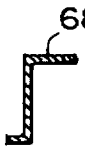
Figure 11B:
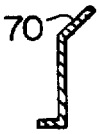

Running within the drum 21 along its longitudinal axis 27 is an elongated, cylindrical core 28. Since it is attached to the drum 21 by brackets 30 and 32 (FIGS. 2, 6, 9), it rotates with the drum 21. The core 28 has a pointed and flighted forward portion 34 and a perforated rear portion 36. The two portions are connected by an interlocking joint 38 (FIG. 4) which is supported by the forward brackets 30 connected to the drum 21. The forward portion 34 of the core 28 has a point 40 which extends into the region 22 of the expanding cross-section of gas flow. Extending from the forward portion 34 of the core 28 are longitudinally oriented flights 42, 44 ("core flights") (see especially FIGS. 2 and 7). Some core flights 42 occupy a single plane, while others 44 are bent—e.,g., into an L-shape. In the L-shaped core flights 44, the leg 46 of the L trails the direction of rotation of the drum (FIG. 7). Core flights 42, 44 which are aligned longitudinally are separated by a gap 50 which allows for thermal expansion and helps to disperse the flowing material.

Figure 2:
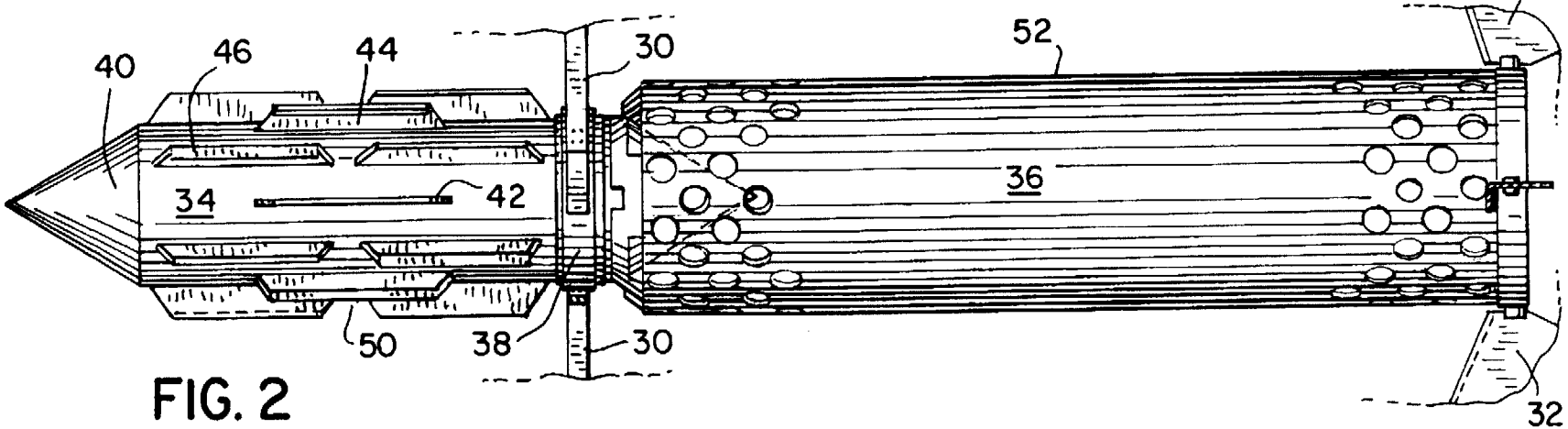
FIG. 2 illustrates a version of the core of the present invention.

The cylindrical wall 52 of the rear portion 36 of the core 28 is perforated substantially along its entire length and circumference (FIGS. 2, 3 and 9). The perforations 54 are arranged in longitudinal lines so that the holes are staggered circumferentially. The perforation holes may have a circular 56 (FIG. 5(*a*), square 58 (FIG. 5(*b*) or other shapes. The holes are sized to allow particles of material to pass through them freely.

Figure 12A:
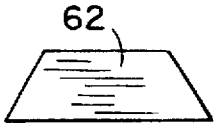
FIGS. 12(*a*) and (*b*) illustrate a straight flight.
Figure 12B:
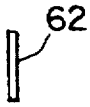
Figure 11C:
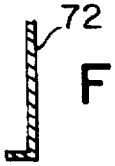
Figure 8:
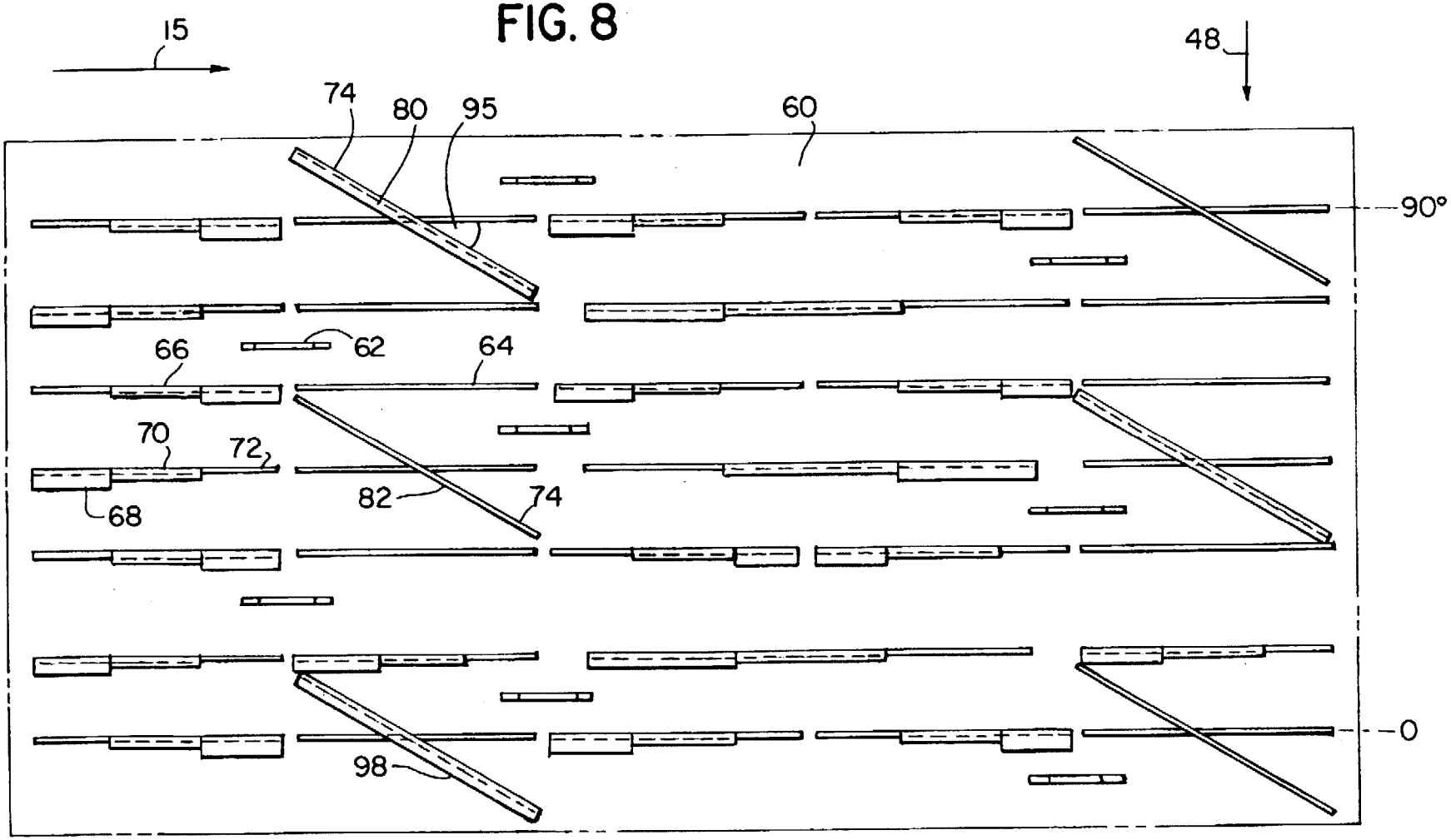
FIG. 8 illustrates a portion (line 8—8 of FIG. 7) of an inner surface of a cylindrical drum wall, with inwardly extending flights, as it would appear if the wall were rolled out flat.

Extending inwardly from the wall 60 of the drum are flights arranged longitudinally in parallel lines ("longitudinal drum flights"). See FIGS. 6, 8, 10. Some of the longitudinal drum flights are relatively short (longitudinally) planar trapezoids 62 (FIG. 12); some are relatively long and low planar rectangles 64; and some 66 are triply bent into portions having a perpendicular leg 68, an oblique leg 70 and a straight leg 72 respectively. The perpendicular 68 and oblique 70 legs lead the direction of rotation 48. As illustrated in FIG. 8, the rectangular flights 64 and the bent flights 66 can be arranged variously along any line and adjacently.

Also extending inwardly from the wall 60 of the drum 21 are flights 74 which are aligned obliquely to the longitudinal axis (referred to herein as "helical drum flights" because they resemble a portion of a helix winding up the inside of the drum). As illustrated in FIGS. 14(*a*) and 15(*a*), the helical drum flights 74 have a curving bottom edge 76 which is shaped so that it is contiguous to the drum wall 60 when the flight 74 is installed at the desired angle relative to the longitudinal axis 27. The bottom edge 76 has a notch so that the helical drum flight 74 can cross over a longitudinal drum flight 64. The top edge of a helical drum flight may be bent to form a leg 80 (FIG. 14(*b*)) or not bent 82 (FIG. 15(*b*)). The bend may have an angle of up to 90 degrees. The leg 80 is employed to enhance the showering of the materials. The helical drum flights 74 may be installed at various angles (up to nearly 90 degrees) relative to the longitudinal axis 27. In FIG. 8, the helical drum flights 74 are shown as being 30 degrees off longitudinal and having lengths which result in them occupying approximately 24 degrees of drum circumference. The helical drum flights 74 could occupy more or less than 24 degrees, depending on their length and the angle of offset from the longitudinal axis 27. They are spaced apart circumferentially so that there are eight helical drum flights 74 around the drum circumference. Longitudinally, the helical drum flights 74 are separated by longitudinal drum flights.

In operation, the core 28 prevents an overly rapid blow-through of material to the outlet 23. The point 40 of the core 28 diverts some material toward the drum wall 21, where it encounters the drum flights 62, 64, 66. The different types of drum flights impart different motions to the material they encounter, creating a multi-directional shower of material through the flow of heated gas. In particular, as illustrated especially in FIG. 7, on the upswing the triply bent flights 66 act as scoops which pick up material and carry it upward. The straight leg 72 dumps its material first roughly toward 84 the near side of the core 28; the oblique leg 70 dumps next, generally toward 86 the top of the core 28; and the perpendicular leg 68 drops last, generally toward 88 the other side of the core 28. The other types of drum flights 62, 64, 74 direct material toward the core 28 in other directions and patterns.

Some of the material which showers onto the forward portion 34 of the core 28 is collected by the L-shaped core flights 42 and is carried to the underside of the core 28 and deposited 90 into the gas flow there, in a space that otherwise tends to be under-utilized. Other material showering onto the forward portion 34 of the core 28 is thrown back into the gas flow by the core flights 42, 44.

Some of the material which showers onto the perforated rear portion 36 of the core 28 passes through 92 the perforations 56 into the interior of the rear portion 36 of the core 28. It remains there for a time during which time it is further dried by the prevailing temperature and the heated gas swirling through the perforations 56. Eventually, it passes 94 out of the rear portion 36 of the core 28 back into the main flow of heated gas. The perforated core portion is an important aspect of the present invention because it increases the dwell time and dispersion of material in the dryer 10, which helps meet a need which the invention addresses.

Each helical drum flight 74 is oriented at an oblique angle relative to the longitudinal axis 27 of the drum 21. The angle is such that incoming material in the lower right quadrant 96 of the drum cross-section encounters the flight 74 as an ascending ramp 98 (FIGS. 8 and 10). This retards the rearward movement of such material and may cause it to slide forward in the face of the flow of heated gas. As the drum continues to rotate, the helical flight 74 provides yet another showering pattern as it releases material while moving up, over and then down. The straight 82 and bent 80 versions of the helical flight 74 also varies the showering pattern.

The apparatus may be made of conventional materials, including stainless steel, and the conical portal 20 and drum 21 may be insulated with ceramic fiber or other material. Conventional heater, fan and drum speed controls (not shown) are provided for varying the initial temperature of the gas flow, the flow rate and the drum rotation rate.

The embodiment of the invention just described provides many advantages. The variety of core flights 42, 44 and drum flights 62, 64, 66, 74 move material particles back and forth through the gas flow in a variety of routes and showering patterns, thereby engaging all areas of the gas flow, increasing dwell time and directing material toward the perforated core 28 from several directions. The helical flights 74 especially increase the dwell time of material particles by presenting incoming material which an ascending ramp, which tends to push the material against the gas flow. The perforated core 28 provides a drying space out of the direct flow of gas, thereby increasing the dwell time of material particles which enter the core 28.

The invention is not restricted to the embodiments described above. Other embodiments may be within the scope of the invention. For example, the core 28 may have only a perforated portion 32 (and not the flighted portion), or the perforated portion 32 may not be perforated over its entire surface. The perforations may have different shapes and may be less or more dense. Further, the helical flights 74 may have different dimensions and may be placed more or less frequently or at different angles. Flights may have curved surfaces.

We claim:

1. A single pass rotary dryer for drying moist material, the dryer comprising:

(a) a blower in communication with a supply of a gas whereby the blower establishes a moving gas stream;

(b) a heater disposed to heat the gas;

(c) a feeder disposed to discharge the material into the gas stream whereby the gas stream carries the material in the same direction as the gas stream;

(d) a drum rotatable in an operating direction about a longitudinal axis, the drum having an inner wall, an inlet in communication with the stream of gas and material and an outlet for discharging the stream of gas and material; and (e) a flight which extends inwardly from the wall of the drum and is aligned at an oblique angle with respect to the longitudinal axis.

2. The single pass rotary dryer of claim 1, in which the oblique angle is approximately 30 degrees.

3. The single pass rotary dryer of claim 2, in which the flight occupies approximately 24 circumferential degrees of the wall.

4. The single pass rotary dryer of claim 1, in which the flight has a bend which forms a leg portion of the flight.

5. A single pass rotary dryer for drying moist material, the dryer comprising:

(a) a blower in communication with a supply of a gas whereby the blower establishes a moving gas stream;

(b) a heater disposed to heat the gas;

(c) a feeder disposed to discharge the material into the gas stream whereby the gas stream carries the material in the same direction as the gas stream;

(d) a drum rotatable in an operating direction about a longitudinal axis, the drum having an inner wall, an inlet in communication with the stream of gas and material and an outlet for discharging the stream of gas and material; and (e) a tubular core mounted longitudinally within the drum, at least a first portion of the tube being hollow and having a wall which is perforated with a plurality of holes which are sized to allow particles of the material to enter and exit the first portion, whereby the particles are delayed within the first portion before exiting the first portion and rejoining the stream of gas and material and exiting the drum through the outlet.

6. The single pass rotary dryer of claim 5, in which at least some of the holes are circular.

7. The single pass rotary dryer of claim 5, in which at least some of the holes are rectangular.

8. The single pass rotary dryer of claim 5, in which the first portion has a narrowing closed end which faces the feeder.

9. The single pass rotary dryer of claim 5, in which the core has a second portion which is substantially unperforated, is located closer to the feeder than the first portion and has a narrowing closed end which faces the feeder.

10. The single pass rotary dryer of claim 9, in which the second portion of the core carries an outwardly extending and longitudinally oriented flight which has a bend defining a leg pointing substantially counter to the operating direction of rotation.

11. The single pass rotary dryer of claim 5, further comprising a flight which extends inwardly from the wall of the drum and is aligned at an oblique angle with respect to the longitudinal axis.

12. An apparatus for drying moist material, the apparatus comprising:

(a) a blower in communication with a supply of a gas whereby the blower establishes a moving gas stream;

(b) a heater disposed to heat the gas;

(c) a feeder disposed to discharge the material into the gas stream whereby the gas stream carries the material;

(d) a drum rotatable in an operating direction about a longitudinal axis, the drum having an inner wall, an inlet in communication with the stream of gas and material and an outlet for discharging the stream of gas and material;

(e) a first flight which extends inwardly from the wall of the drum and is aligned at an oblique angle with respect to the longitudinal axis;

(f) a second flight which extends inwardly from the wall of the drum and is parallel to the longitudinal axis, the second flight having a bend which defines a first portion extending at least partially in the direction of rotation;

(g) a tubular core mounted longitudinally within the drum, at least a first portion of the tube being hollow and having a wall which is perforated with a plurality of holes;

(h) a second portion of the core, which is substantially unperforated, is located closer to the feeder than the first portion, has a narrowing closed end which faces the feeder has an outwardly extending and longitudinally oriented third flight formed on the core, the third flight having a bend defining a first portion adjacent the core and a second portion beyond the bend, the second portion pointing substantially counter to the operating direction of rotation.

13. For a single pass rotary dryer for drying moist material, the dryer being of the type which has a drum longitudinally rotatable in an operating direction and further which has a blower, a heater and feeder which combine to introduce a stream of heated gas and material into the drum in the same direction, the drum having flights on an internal wall for deflecting and showering material within the drum and having an outlet for discharging the stream of gas and material, a core comprising a cylinder disposed to be mounted longitudinally within the drum, at least a first portion of the cylinder being hollow and having a wall which is perforated with a plurality of holes which are sized to allow particles of the material to enter and exit the first portion, whereby the particles are delayed within the first portion before exiting the first portion and rejoining the stream of gas and material and exiting the drum through the outlet.

14. The core of claim 13, in which at least some of the holes are circular.

15. The core of claim 13, in which at least some of the holes are rectangular.

16. The core of claim 13, in which the first portion has a narrowing closed end which faces the feeder.

17. The core of claim 13, in which the core has a second portion which is substantially unperforated, is located closer to the feeder than the first portion and has a narrowing closed end which faces the feeder.

18. The core of claim 17, in which the second portion of the core carries an outwardly extending and longitudinally oriented flight which has a bend defining a leg pointing substantially counter to the operating direction.

19. For a single pass rotary dryer for drying moist material, the dryer being of the type which has a cylindrical drum rotatable in an operating direction about a longitudinal axis, the drum having a cylindrical internal wall surface, the dryer further having a blower, heater and a feeder which combine to introduce a stream of heated gas and material into the drum in the same direction, a flight comprising a blade having a curving side shaped to be continguous with the internal wall surface when the flight is aligned at a preselected oblique angle with respect to the longitudinal axis, whereby the flight presents an ascending ramp to incoming material during at least part of each rotation of the drum and thereby retards the passage of the material through the drum and increases the dwell time of the material within the drum.

* * * * *